US005945969A

United States Patent [19]

Westphal

[11] Patent Number: 5,945,969

[45] Date of Patent: Aug. 31, 1999

[54] UNIFORMLY BRIGHT FIELD EMISSION DISPLAY

[75] Inventor: Michael J. Westphal, Boise, Id.

[73] Assignee: Micron Technology, Inc., Boise, Id.

[21] Appl. No.: 08/696,388

[22] Filed: Aug. 14, 1996

[51] Int. Cl.[6] ..... G09G 3/22

[52] U.S. Cl. ..... 345/75; 345/74

[58] Field of Search ..... 345/41, 60, 63, 345/64, 74, 75; 315/169.1, 169.4

[56] References Cited

U.S. PATENT DOCUMENTS 4,710,765 12/1987 Ohkoshi et al. ..... 345/77

*Primary Examiner*—Matthew Luu
*Attorney, Agent, or Firm*—Hale and Dorr LLP

[57] ABSTRACT

An anode of a field emission display has a substrate, a conductive layer, and one or more conductive members kept at a potential higher than the conductive layer to increase the component of the electric field normal to the surface of the anode at corners and edges of the anode so that the brightness across the display is more uniform than it would be without the conductive members.

22 Claims, 2 Drawing Sheets

UNIFORMLY BRIGHT FIELD EMISSION DISPLAY

STATEMENT OF GOVERNMENT RIGHTS

This invention was made with Government support under Contract No. DABT63-93-C-0025 awarded by the Advanced Research Projects Agency (ARPA). The Government may have certain rights in this invention.

FIELD OF THE INVENTION

This invention relates to a field emission display.

BACKGROUND OF THE INVENTION

A field emission display (FED) has a cathode with many conical electron emitters arranged in a row-column selectable array, and an anode with phosphor-coated pixels. When selected for actuation, the emitters bombard the pixels with electrons to produce light, thus creating an image for a viewer. The brightness of that image depends on the level of current between the cathode and the anode; and the level of current depends on the electric field between the cathode and the anode in a direction normal to the anode. The electric field due to the potential of the anode at each emitter tip is higher for tips of emitters in the center of the array, lower for tips of emitters at the edge of the array, and lower still for tips of emitters at the corners of the array. These center-edge-corner variations in the electric field across the anode thus cause variations in the brightness from the center to the edges to the corners of the displayed image.

SUMMARY OF THE INVENTION

According to the present invention, in an FED flat panel display with a cathode with a selectable array of emitters, the anode faces the array and has a substrate, a conductive layer over part of the substrate, and one or more conductive members over a portion of the periphery of the substrate. A power source coupled to the conductive layer and conductive member(s) holds the conductive member(s) at a potential higher than that of the conductive layer to increase the electric field at the corners and edges of the array so that the electric field normal to the anode is more uniform across the anode than without the conductive members.

In a preferred embodiment, the anode substrate is made of soda-lime glass, and the conductive layer and conductive member(s) are made of indium tin oxide (ITO). The conductive members are preferably L-shaped, are provided at each corner of the anode substrate, and have the same thickness as the conductive layer. The members can be provided in other shapes or configurations, including as a single guard ring surrounding the conductive layer. The power source provides DC bias so that there is a relatively large potential difference between the cathode and anode, and a relatively small potential difference between the conductive layer and conductive member(s) of the anode.

By increasing the component of the electric field normal to the surface of the substrate of the anode at its edges and corners, the electric field across the anode is more uniform, and hence the brightness is more uniform than was achieved without the members. Other features and advantages will be apparent from the following detailed description and claims when read in conjunction with the drawings.

DETAILED DESCRIPTION OF AN EMBODIMENT

Figure 1:
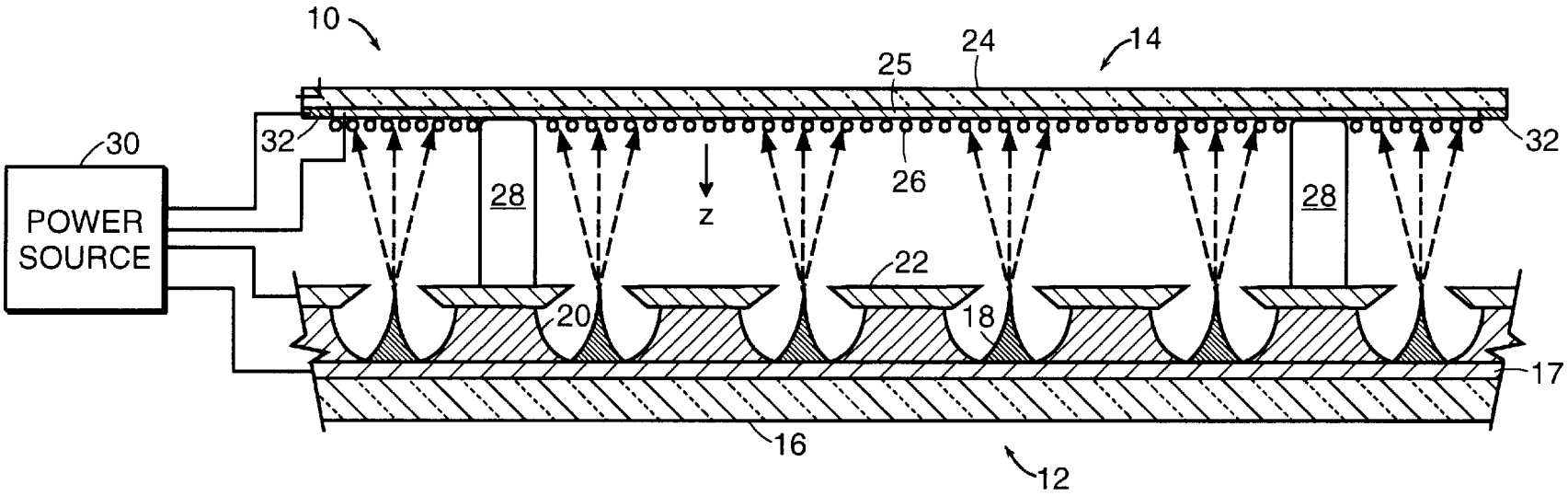
FIG. 1 is a cross-sectional view of an FED according to a first embodiment of the present invention.

Referring to FIG. 1, an FED 10 has a cathode 12 and an anode 14. Cathode 12 has a glass substrate 16, a number of conductive layers 17 over substrate 16, and an array of conical emitters 18 over conductive layers 17. Emitters 18 are surrounded by a dielectric layer 20, and a conductive grid 22 is formed over dielectric layer 20.

Anode 14 includes a transparent substrate 24, a transparent conductive layer 25 over substrate 24, and a black matrix grille (not shown) formed over conductive layer 25 to define pixel regions. A phosphor coating 26 is deposited on these defined pixel regions. Substrate 24 is preferably soda-lime glass, layer 25 is preferably indium tin oxide (ITO), and the black matrix is preferably cobalt oxide. Anode 14 is spaced from cathode 12 with a number of dielectric spacers 28.

A power source 30 is electrically coupled to conductive layers 17, grid 22, and conductive layer 25 for providing an electric field that causes the emitter to emit electrons to the phosphor-coated regions 26 of anode 14. Power source 30 also connects to grid 22 and conductive layers 17 for row-column addressing to selectively activate desired emitters. Exemplary DC voltages are as follows: layers 17 are grounded; grid 22 is at about 40–100 volts; and layer 25 in the anode is at about 1000 volts.

Figure 2:
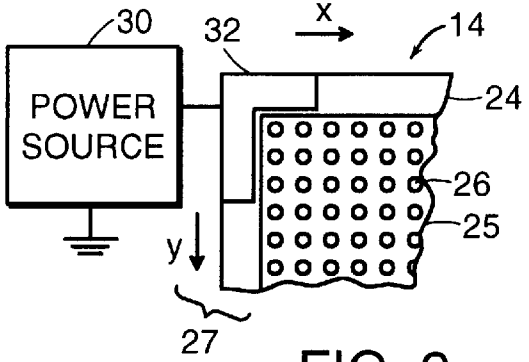
FIG. 2 is a plan view of an anode according to a first embodiment of the present invention.

Referring also to FIG. 2, according to the present invention, when conductive layer 25 is formed over substrate 24, a peripheral area 27 without layer 25 is defined around the perimeter of substrate 24. One or more conductive members 32 are formed in this peripheral area and are coupled to power source 30. Source 30 holds members 32 at a potential that is higher than that of conductive layer 25; e.g., while conductive layer is at 1000 volts DC, members 32 are at about 1200 volts DC. Accordingly, with these exemplary values, conductive layer 25 in the anode and conductive layers 17 and grid 22 in the cathode have a relatively large potential difference of about 1000 volts DC, and layer 25 and members 32 have a relatively small exemplary potential difference of about 200 volts DC. Because of their higher potential, members 32 increase the component of the electric field normal to substrate 24 at its edges and corners to provide a more uniform electric field across the entire anode surface. Consequently, the electrons emitted from all of the cathode emitters are accelerated by a more uniform electric field to strike the anode with more similar kinetic energy. The result is a more uniform brightness from the center to the edges and to the corners of the display than was previously achieved without such members.

Members 32 can be formed with one of a number of different shapes and configurations. In one embodiment, members 32 are each L-shaped with legs that extend about 30–40% of the length of the respective side of the anode. Members 32 can be made from any conductive thin film, and are preferably ITO that is formed on substrate 24 when layer 25 is formed by sputter deposition techniques.

Figure 3:
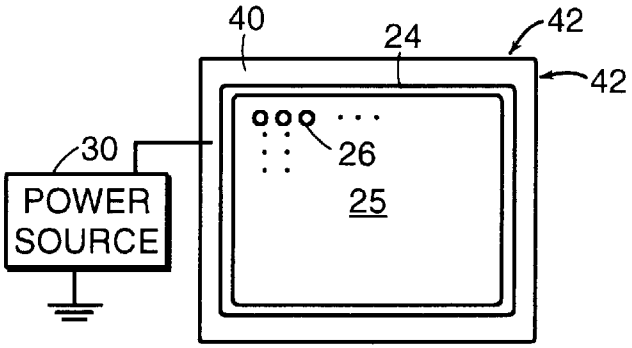
FIG. 3 is a plan view of an anode according to a second embodiment of the present invention.

One or more such members can be provided in a different shape or configuration from the L-shaped configuration shown in FIG. 2. Referring to FIG. 3, as an exemplary (but less preferred) alternative to the L-shaped members, a guard ring 40 can completely surround the conductive layer on the anode. In this embodiment, conductive layer 25 covers all but a peripheral area 42 of substrate 24, and guard ring 40 covers most of peripheral area 42 and surrounds layer 25. Power source 30 is coupled to guard ring 40 to keep it at a potential that is higher than that of conductive layer 25.

Still other configurations can be used. For example, a series of conductive members can be provided around a periphery with those at the corners having the highest potential, those along edges having a lower potential, while the conductive layer has an even lower potential. Such an arrangement could increase uniformity, but at the expense of simplicity and practicality.

In all of these embodiments, the thickness of members 32 or guard ring 40 is preferably about the same as that of conductive layer 25 on substrate 24, i.e., about 0.1–1 microns.

Figure 4A:
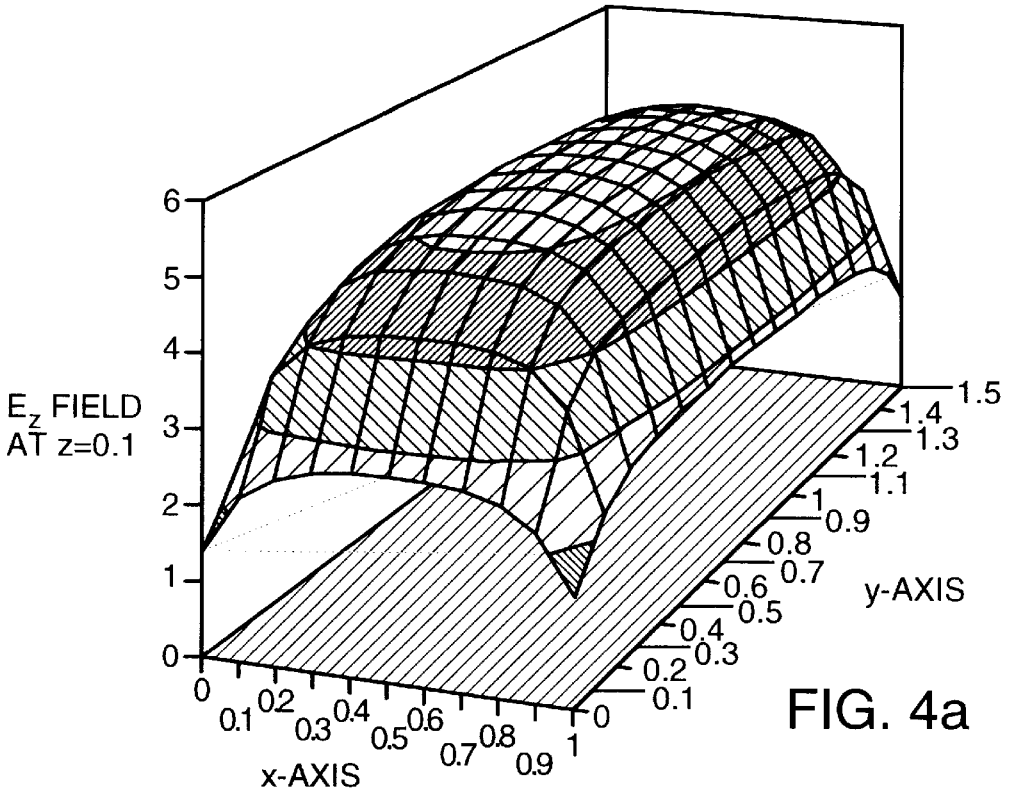
FIGS. 4(*a*) and 4(*b*) are three-dimensional graphs illustrating the component of the electric field normal to the anode without and with conductive members, respectively.
Figure 4B:
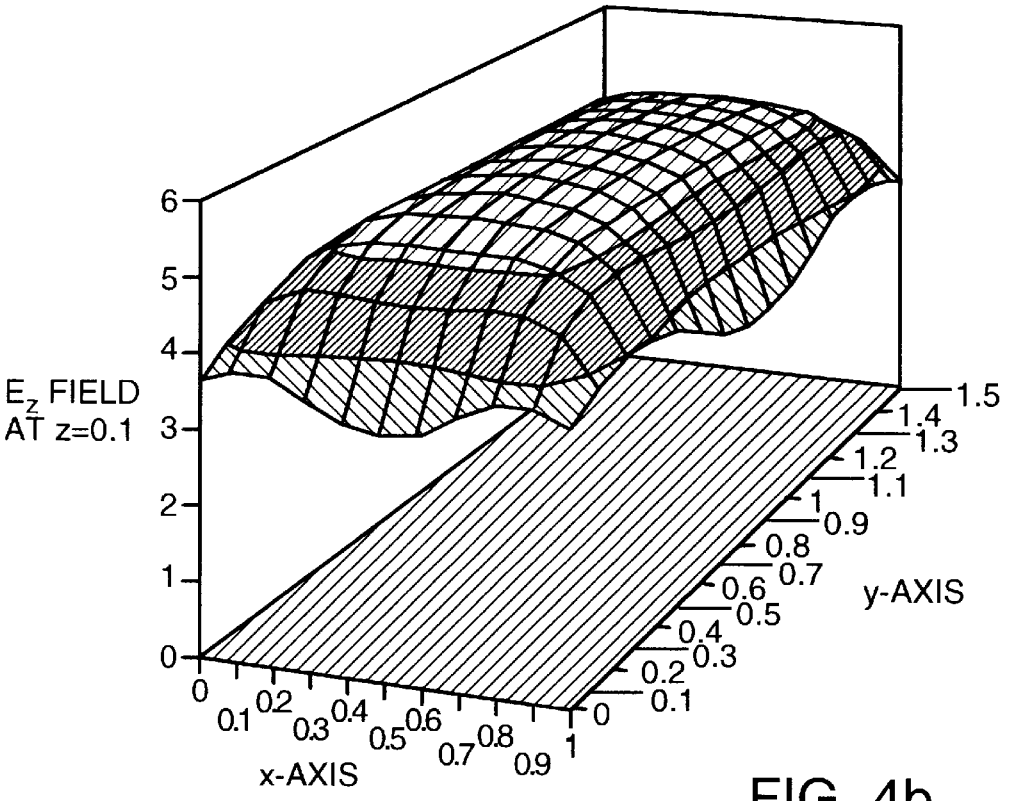

FIGS. 4(*a*) and 4(*b*) are three-dimensional plots of the component of the electric field in a direction perpendicular to the x-y plane at z=0.1 (normalized) over the x-y plane of the anode. As shown in FIGS. 1 and 2, the x and y directions are in the plane of the substrate, and the z direction is normal to the substrate. Comparing FIG. 4(*a*), which was calculated for an anode without conductive members, to FIG. 4(*b*), which was calculated with an anode with L-shaped conductive members in each of the corners, it is apparent that the maximum magnitude of the electric field in the center of the anode does not vary much from FIG. 4(*a*) to FIG. 4(*b*), but the magnitude at the edges and corners is boosted from a minimum relative magnitude of about 1.5 to a minimum relative magnitude of about 3. Moreover, the area over which $E_z$ is at least about 5 and relatively uniform over an x-y area is increased significantly. As noted above, this more uniform field corresponds to more uniform brightness across the display.

Having described embodiments of the present invention, it should be apparent that modifications and changes can be made without departing from the scope of the invention as defined by the appended claims. For example, while specific potentials, materials, and dimensions have been recited, other appropriate values could be used.

What is claimed is:

1. A field emission display comprising:

an anode including:

a substrate, a conductive layer covering a portion of the substrate and defining an uncovered peripheral area of the substrate, and at least one conductive member covering at least a portion of the peripheral area of the substrate; and a power source coupled to the conductive layer and to the conductive member, the power source for holding the conductive member at a potential higher than a potential of the conductive layer.

2. The display of claim 1, wherein the conductive member is L-shaped with legs that extend about 30–40% the length of sides of the substrate of the anode.

3. The display of claim 2, wherein the substrate has four corners and wherein there are four L-shaped conductive members, one at each of the four corners of the substrate.

4. The display of claim 1, wherein the conductive member has a composition and thickness similar to that of the conductive layer.

5. The display of claim 1, wherein the conductive member includes a ring that surrounds the conductive layer.

6. The display of claim 1, further comprising a cathode having a plurality of conductive layers, and a plurality of emitters coupled to the conductive layers emit electrons toward the anode, wherein the power source is coupled to the cathode's conductive layers such that the potential difference between the anode's conductive layer and the cathode's conductive layers is relatively high compared to the potential difference between the conductive member and the anode's conductive layer.

7. The display of claim 1, wherein the substrate has a number of corners, the anode having at least one conductive member at each corner.

8. The display of claim 1, wherein the conductive layer is covered with a phosphor coating to form pixel regions.

9. A field emission display comprising:

a cathode having a first substrate and a plurality of selectable electron emitters arranged in an array over the substrate; and an anode including:

a second substrate parallel to and spaced from the first substrate, the substrate having a perimeter, a conductive layer formed over the second substrate and facing the cathode, and means for increasing a component of the electric field normal to the second substrate at the perimeter of the second substrate so that the electric field normal to the second substrate is more uniform from the perimeter to the center of the array than it would be without said increasing means.

10. The system of claim 9, wherein the increasing means includes at least one conductive member at the perimeter of the second substrate, and a power source for biasing the conductive member.

11. The system of claim 9, wherein the perimeter has corners and wherein the conductive members are L-shaped and formed at the corners.

12. A method comprising:

forming a transparent conductive layer on a portion of a transparent dielectric substrate, the transparent substrate having a peripheral region;

forming at least one conductive member on a portion of the peripheral region not covered by the conductive layer;

providing a phosphor coating over at least part of the conductive layer to produce an anode; and coupling the conductive layer and the conductive member to a power source so that the potential of the conductive member can be held at a potential that is higher than that a potential of the conductive layer.

13. The method of claim 12, wherein forming a transparent conductive layer includes forming an L-shaped conductive member in a corner of the substrate.

14. The method of claim 12, wherein forming at least one conductive member includes forming a conductive ring that surrounds the conductive layer.

15. The method of claim 12, wherein forming a transparent conductive layer includes forming a layer of indium tin oxide by sputter deposition.

16. The method of claim 15, wherein forming at least one conductive member includes forming at least one conductive member of indium tin oxide by sputter deposition.

17. A method for operating a display having a cathode with a substrate, a plurality of conductive layers over the substrate, and a plurality of emitters on the conductive layer, and an anode with a substrate, a conductive layer over the substrate, at least one conductive member over the substrate and not electrically coupled to the conductive layer, and a phosphor coating over at least parts of the conductive layer of the anode, the method comprising:

biasing the conductive layer of the anode and the conductive layers of the cathode to create a relatively large first potential difference therebetween; and biasing at least one conductive member on the anode to a potential greater than the potential of the conductive layer of the anode to create a relatively small second potential difference therebetween.

18. The method of claim 17, wherein biasing the conductive layer includes biasing so that the first potential difference is about 1000 volts.

19. The method of claim 18, wherein biasing at least one conductive member includes biasing so that the second potential difference is about 200 volts.

20. The display of claim 1, wherein the substrate and conductive layer are transparent.

21. The display of claim 6, wherein the substrate and conductive layer are transparent.

22. The display of claim 9, wherein the second substrate and conductive layer are transparent.

* * * * *